US006827398B2

(12) United States Patent
Nazginov

(10) Patent No.: US 6,827,398 B2
(45) Date of Patent: Dec. 7, 2004

(54) ONE-PIECE SLIPCOVER WITH SEPARATE POCKETS FOR SEAT CUSHIONS FOR A FITTED APPEARANCE

(76) Inventor: Arthur Nazginov, 58-25 Laurel Hill Blvd., Woodside, NY (US) 11377

( * ) Notice: Subject to any disclaimer, the term of this patent is extended or adjusted under 35 U.S.C. 154(b) by 0 days.

(21) Appl. No.: 10/265,507

(22) Filed: Oct. 4, 2002

(65) Prior Publication Data

US 2004/0066068 A1 Apr. 8, 2004

(51) Int. Cl.[7] ..... A47C 27/00
(52) U.S. Cl. ..... 297/228; 297/225; 297/228.11
(58) Field of Search ..... 297/224, 225, 297/228, 228.1, 228.11, 229, 219.1, 218.1

(56) References Cited

U.S. PATENT DOCUMENTS

| | | | | | |
|---|---|---|---|---|---|
| 1,695,244 | A | | 12/1928 | Cohen | |
| 1,825,909 | A | | 10/1931 | Levi | |
| 2,183,828 | A | * | 12/1939 | Trubitz | 297/224 |
| 2,367,450 | A | | 1/1945 | Trubitz | |
| 2,871,924 | A | * | 2/1959 | Trubitt | 297/228 |
| D280,481 | S | * | 9/1985 | Kornegay | D6/611 |
| 4,838,610 | A | * | 6/1989 | Perrin | 297/225 |
| 5,549,355 | A | * | 8/1996 | Illulian | 297/224 |
| 5,664,831 | A | * | 9/1997 | White et al. | 297/225 |
| 6,116,685 | A | * | 9/2000 | White et al. | 297/218.1 |

OTHER PUBLICATIONS

Search Report from European Patent Office dated Dec. 12, 2003 issued in relation to patent application No. EP 03 02 2312.

* cited by examiner

*Primary Examiner*—Peter M. Cuomo
*Assistant Examiner*—Stephen Vu
(74) *Attorney, Agent, or Firm*—Ostrolenk, Faber, Gerb & Soffen, LLP

(57) ABSTRACT

A one-piece slipcover for covering pieces of furniture. The slipcover includes first and second pouches where the first pouch defines a seat cushion covering and the second pouch defines a furniture base covering portion. Each of the portion has its own perimeter adjusting portion in the form of a cinching element. The outer cinching element for the main body portion circumscribes the inner cinching element for the seat cushion covering with a portion of the two cinching elements extending substantially parallel to one another with a predetermined spacing therebetween, so as to allow the entirety of the first cinching elements to be tucked under the seat cushion.

19 Claims, 8 Drawing Sheets

ONE-PIECE SLIPCOVER WITH SEPARATE POCKETS FOR SEAT CUSHIONS FOR A FITTED APPEARANCE

BACKGROUND OF THE INVENTION

The present invention is directed to ready-made slipcovers for upholstered furniture, such as sofas, chairs, davenports, futons and the like, and, more particularly, relates to ready-made, one-piece slipcovers that define a separate pocket for the seat cushion of the chair or the sofa, with elastic or non-elastic cinching expedients to gather the material of the slipcover at the base of the sofa to provide a neat and better fitted appearance for the slipcover.

The prior art and printed literature, including patents on the subject of slipcovers stretches back over a time period that spans at least a century. As early as 1928, Arthur Cohen, in his U.S. Pat. No. 1,695,244, describes a unitary slipcover for a seat having a separable cushion which within certain limits may fit seats of different styles and sizes and which, when applied to the seat, has the appearance of a custom-made slipcover of the type in which a separate cover is provided for the seat cushion.

In the 1930 vintage, U.S. Pat. No. 1,825,909, J. Levi describes a slipcover with resilient inserts which tend to draw the cover tightly over the front face or the back for eliminating wrinkles, thus presenting a neat appearance. The design uses elastic strings and various fasteners, so that the cover can be made up in a single size or only a few stock sizes and be placed in position by the purchaser in but a few minutes.

Another slipcover that can be applied to chairs or sofas of many different sizes and shapes with portions that accommodate the corner shoulders of the furniture and with tension or means to draw the cover over the entire surface of the furniture to simulate a custom-made cover for the chair or sofa is described in U.S. Pat. No. 2,367,450. The patent discloses the use of elastic drawstrings throughout various take-up points in the slipcover, to present a tight and custom-fitted appearance.

Similar technology is disclosed in U.S. Pat. No. 2,667,211 to G. S. Krasnov, et al., which describes a ready-made slipcover which, notwithstanding variations in the dimensions of the furniture pieces, provides various means to avoid the slipcovers from becoming baggy or wrinkled in spots through, among other things, the expedient of providing the material in stretchable form or with threads extending therethrough at various intervals to draw in and to shirr the rear edges of certain sections of the slipcover. The various strings described in the prior art may be elastic or non-elastic, as in a case where two ties are provided at different spots on the periphery of the material which can be drawn together and tied to present a tight and fitted appearance.

Similarly, the 1989 patent to Perrin (U.S. Pat. No. 4,838,610), describes a protective cover for upholstered furniture that is not form-fitted like slipcovers, but which, unlike throws, remains in proper position. The cover is in the form of a shaped tub that fits over the furniture and includes at the bottom thereof, a drawstring to present a tight and neat appearance. The drawstring can be formed of strings or it can be in the form of "Velcro" strips and the like.

Other patent literature disclosing the use of elastic cords, stitching seams and bands and fasteners to better fit a slipcover to a chair or sofa, is represented by U.S. Pat. Nos. 1,825,909; 1,857,418; 2,884,993 and 5,320,407.

A one-piece slipcover with an especially made seat cushion pocket that is defined in the cover where the lip of the pocket at its entry is circumscribed by elastic materials is described in United Kingdom patent specification 1 300 582.

More recently, U.S. Pat. No. 5,664,831 has issued in relation to a semi-fitted, one-piece slipcover that has a seat cushion covering portion that is surrounded by a cinching element for reducing its effective peripheral dimension and a main body portion that covers the rest of the furniture with a portion of the cinching element of the seat cushion covering portion running co-extensively with a similar cinching element that surrounds the main body portion of the slipcover.

The subsequent U.S. Pat. No. 6,116,685 describes a modification to the slipcover in the aforementioned U.S. Pat. No. 5,664,831 patent, in which the cinching element for the seat cushion covering portion does not circumscribe the seat portion, to avoid a shirring effect on the front-facing portion of the furniture which may be a chair or a sofa. The contents of the aforementioned U.S. Pat. Nos. 5,664,831 and 6,116,685 are incorporated by reference herein.

Despite the wealth of prior art on the subject of slipcovers, the present inventor perceives that he has invented a novel and unobvious combination of features that provide the ease, utility and versatility of one-piece slipcovers, but which attains a more fitted appearance, despite the universality of the design.

SUMMARY OF THE INVENTION

Accordingly, it is an object of the present invention to provide an improved one-piece slipcover that is better suited to provide a neater and better fitted covering for upholstery.

It is another object of the present invention to provide a one-piece slipcover that is easily and economically producable.

It is yet a further object of the invention to provide a one-piece slipcover that is easy to use and apply to upholstered furniture and which has the utility and versatility that it can be applied to a variety of different sized and shaped furniture.

A further object of the invention is to provide a slipcover with a specially defined seat cushion pocket that has an opening therein that is defined by a circumscribed resilient band to better hug and fit a seat cushion or cushions and to retain the fitted appearance despite a person's numerous sitting down or getting up from the seat cushion of the furniture.

The foregoing and other objects of the invention are realized by a slipcover for a piece of furniture that includes at least a base and at least one seat cushion in which the slipcover defines a pouch-like seat cushion covering portion including a first cinching element comprising a circumference adjusting member for varying the peripheral dimension of the seat cushion covering portion and a pouch-like, main body portion for covering the base of the piece of furniture with the main body portion having its own second cinching element comprising a perimeter adjusting member.

The perimeter adjusting member surrounds the circumference adjusting member and the two members have a section thereof that run substantially parallel to one another but with a predetermined spacing. Thereby, when mounted on the piece of furniture, the circumference adjusting member of the covering cushion becomes tucked under the seat cushion while the section of the perimeter adjusting member remains exposed.

The cinching or adjusting members can be implemented in a variety of configurations, including where both members are made of elastic materials, in the form of endless elastic bands. Alternatively, the circumference adjusting member is constructed of an elastic band while the perimeter adjusting member is constructed of a non-elastic, non-stretchable material. As a further alternative, the perimeter adjusting member is constructed of an elastic band except for the parallel running section which is constructed of a non-elastic, non-stretchable material.

For those embodiments that use the perimeter adjusting member where at least a portion is non-stretchable, the invention provides several pairs of fastening ties that can be used to gather the material of the slipcover about the piece of furniture to provide a more fitted appearance. The appearance can be of ruffled or smoothed material of the slipcover.

As used herein, the cinching or adjusting members refer to endless, or non-endless, string-like, band of material that is held in a pocket made in the material or sewn to the material or intertwined stitch-like, through the material. The cinching elements can be elastic, so as to gather the material inward, or can be drawn non-elastic, but pullable to change the circumference of either the seat cushion covering portion, or the main body portion. A line of stitching connecting pieces of the material of the slipcover, in and of itself, does not constitute a cinching or an adjusting member. Similarly, the fastening ties which can be drawn toward one another and thereafter tightened and knotted together, do not constitute cinching elements in the sense of the present invention.

Other features and advantages of the present invention will become apparent from the following description of the invention which refers to the accompanying drawings.

DETAILED DESCRIPTION OF PREFERRED EMBODIMENTS OF THE INVENTION

Figure 1:
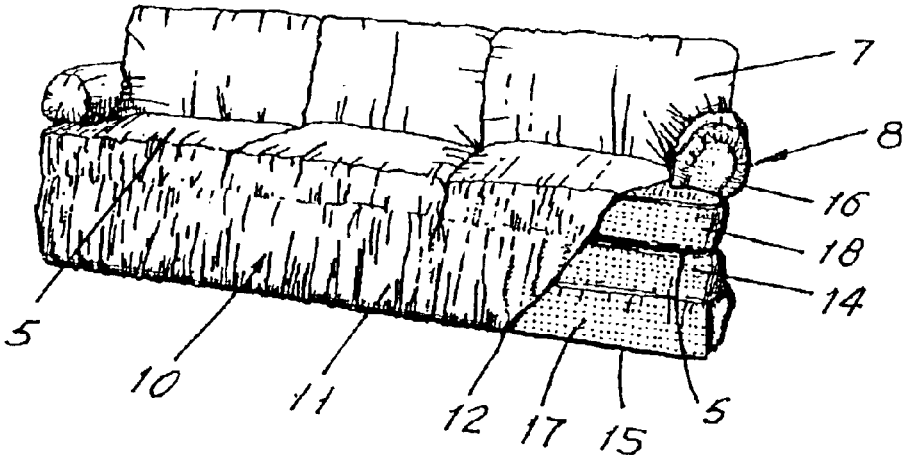
FIG. 1 PRIOR ART
FIG. 1 perspectively illustrates a prior art slipcover.

With reference to the drawings, in which identical parts are identically marked, prior art FIG. 1 shows the typical sofa or chair 8 provided with one or more cushions 18 that rest on a base 14, with an upholstered finish that includes a ruffle 17 that reaches to the floor 15. In typical fashion, the chair or sofa includes armrests 16, as indicated.

With particular relevance to the present invention, this prior art drawing shows a tub-shaped slipcover 10 with a portion 5 resting on the cushions 18, made of fabric of a size that enables it to cover the piece of upholstered furniture to be protected thereby. The line 12 denotes a portion of the cover 10 that has been removed to reveal the underlying components. The slipcover 10 has a continuous integral peripheral bottom portion 11 that defines a single opening into the tub-shaped cover 10 that is designed to allow the slipcover to be lowered onto the sofa 8, there being provided special pockets for the armrests 8 and the backrest 7 of the sofa. Although not shown in FIG. 1, U.S. Pat. No. 4,838,610 describes that the slipcover can be provided along the bottom thereof with stitching and a drawstring to gather excess material and to cleat and hold it at the selected length needed to tighten the bottom portion of the slipcover against the base of the furniture.

Figure 2:
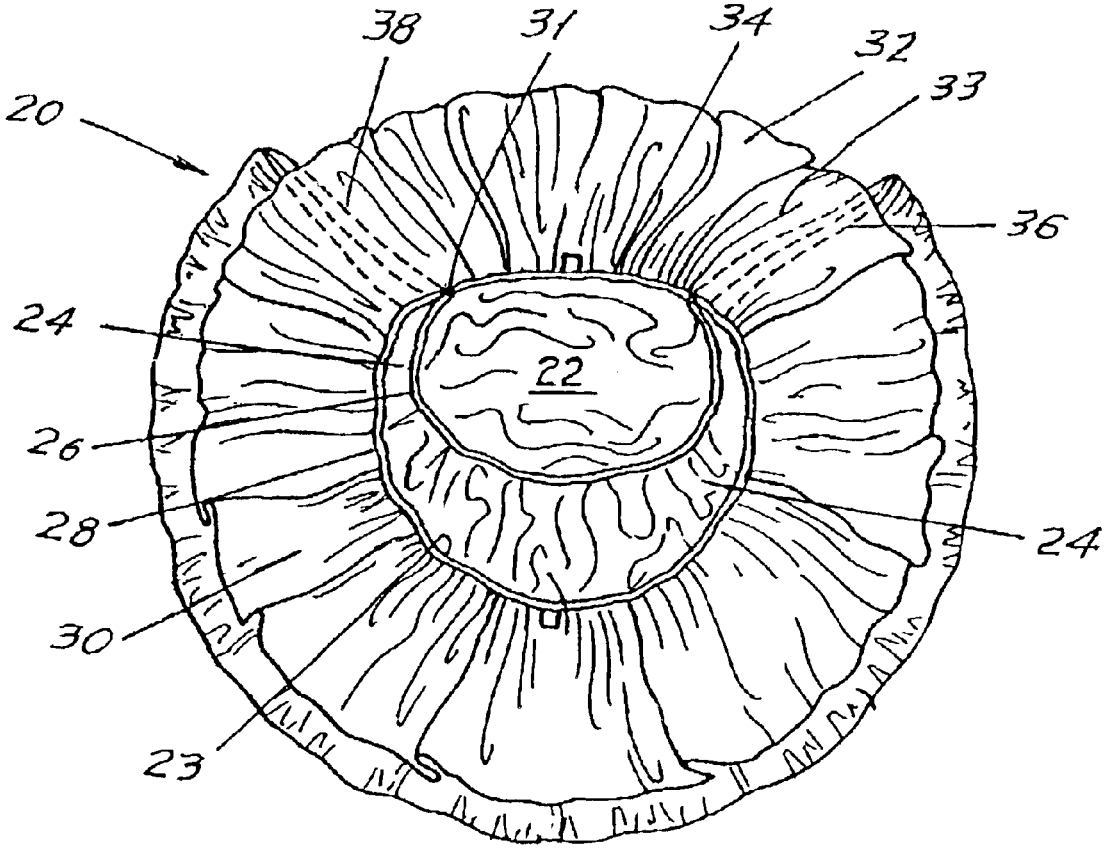
FIG. 2 PRIOR ART
FIG. 2 illustrates a prior art, one-piece slipcover with a special pocket defined in the cover for a seat cushion.

Another prior art slipcover design is illustrated in FIG. 2, in the form of a slipcover 20 consisting of several pieces of fabric sewn together to form a substantially mushroom-shaped pouch 22 for the seat cushion, which pouch is preferably substantially oval or round. This seat cushion pouch or covering portion 22 is preferably formed of a body of material of fabric, and is substantially surrounded by a cinching element 26 which controls the effective peripheral dimension of the seat cushion covering portion. This cinching element 26 is in the form of an elastic band which is secured to the periphery of the seat cushion covering portion 22, while the band is in an extended or stretched condition. In this way, when the band is allowed to relax and return to an unstretched condition, it cinches the periphery of the seat cushion covering portion 22 in a manner similar to a shower cap. Thus, the seat cushion covering portion 22 has the expanse of material with a retracted peripheral dimension, thereby forming a three-dimensional mushroom-shaped pouch, which can readily envelope the cushion, e.g., the cushion or cushions 18 (FIG. 1) of a piece of furniture.

A main body portion 24 of the slipcover 20 is formed as a long, substantially rectangular piece of material which is folded length-wise and secured to itself along seams 36 and 38 at either end. Preferably, these seams are formed by sewing. However, other attachment means, such as adhesive bonding or the like could be used. These seams define the arm covering portions (see prior art FIG. 3) of the slipcover 20. In known manner, the main body portion 24 is preferably inverted subsequent to the seaming step, in order that any seam allowance (not shown) formed at the seams will be located on the inside of the slipcover 20 when it is positioned on the item of furniture 8, to thereby provide a neater appearance.

The main body portion 24 of the slipcover 20 is secured at a first length-wise side thereof to the seat covering portion 22, adjacent the location of the elastic band 26, in a manner so that the main body portion 24 extends approximately ⅔ around the periphery of the seat cushion covering portion 22. In one form of the invention, this first side of the main body portion 24 is joined to the seat cushion covering portion 22, while the cinching element 26 is in its extended position, so that upon release of the tension on the cinching element, the effective length of the first length-wise side of the main body portion is reduced due to the gathering of the first length-wise side material by the cinching element.

The second longitudinal side 23 of the main body 24 is preferably free (i.e., substantially unattached to the seat cushion covering portion 22), to form an open pouch with the first longitudinal side 26 and the arm covering portions.

The second longitudinal side 23 preferably includes a cinching element 28 to enable a reduction of the effective length thereof. The cinching element 28 is in form of an elastic band which is secured to the second longitudinal side 23, while the band is in an extended condition; in this way, when the elastic band is allowed to return to its relaxed, unextended condition, it reduces the effective dimension of the second longitudinal side and gathers the material of the main body portion 24 therealong. The cinching element 28 retracts to a lesser extent or is longer than the cinching element 26, so that when each of the cinching elements is in its relaxed, substantially unstretched condition, a substantially open pocket is formed by the main body portion 24. The elements 26, 28 meet at 31. Alternatively, the main body portion 24 may have an extended length proximate it longitudinal side 23, again, so that an open pocket is formed between the first and second longitudinal side when the first longitudinal side is secured to the seat cushion covering portion 22.

The substantially rectangular main body portion 24 may be wider at its center than at its sides, thereby providing a greater amount of material fullness proximate the middle thereof, i.e., in the region opposite the section of the seat cushion covering portion 22, which is not encircled by the first longitudinal side adjacent the cinching element 26.

To provide a more finished look to the slipcover 20, a skirt 30 with front ruffles 32 and crease lines 33 can be provided at lower portion of the cover. The skirt 30 is preferably provided as a long rectangular piece of material or fabric which secures about its longitudinal edges to the seat cushion covering and main portions 22 and 24 of the slipcover. The skirt 30 has one or two longitudinal sides secured to the cinching element 28 of the main body portion, and it continues around the front section of the seat cushion covering portion 22, which is not encircled by the main body portion 24, where it is preferably secured proximate cinching element 26.

Figure 3:
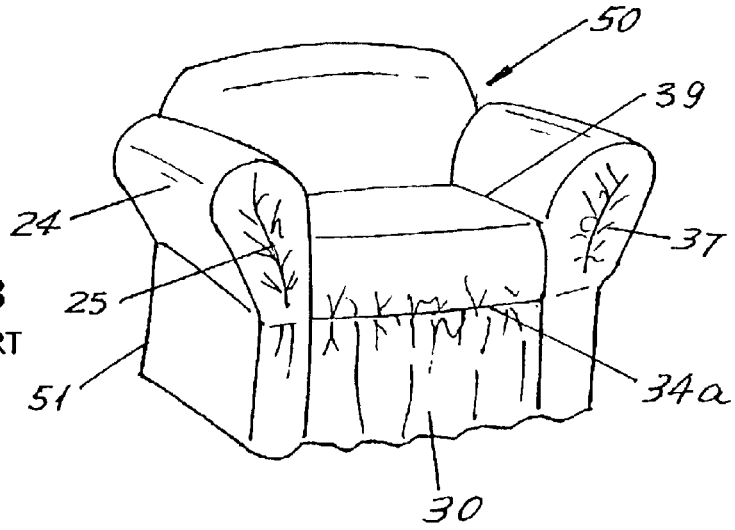
FIG. 3 PRIOR ART
FIGS. 3 and 4 perspectively show a chair and a sofa which are covered by slipcovers of the prior art, including of the type described in U.S. Pat. Nos. 5,664,831 and 6,116,685.

When the slipcover 20 of FIG. 2 is properly positioned on a item of furniture, as for example, on an upholstered sofa chair 50 that is illustrated in FIG. 3, the substantially mushroom-shaped seat cushion covering portion is positioned over the seat cushion in manner of a shower cap being secured over a wearer's hair. Because the cinching element 26 effectively reduces the periphery of the seat cushion covering portion 22, it has a natural tendency to draw beneath the seat cushion 18, and into the crevices 39 between the cushion and the rest of the furniture parts. Because the cinching element 26 cinches the seat cushion covering portion 22 mostly beneath the seat cushion 18 of the sofa chair, the seat cushion is securely and neatly covered by the slipcover 20. Further, because the slipcover is drawn into the crevices 39 between the seat cushion portion 22 and the base, the division therebetween is naturally delineated, thereby providing a semi-fitted appearance.

The main body portion 24 preferably covers the back 51 of the chair 50, and the cinching element 28 extends around the outer side of the sofa chair to secure this portion of the slipcover thereon. Where the cover 20 is used to cover the chair 50 having the arms 35 and 37, the main body portion 24 also is designed to cover the arms and the cinching element extends around the back 16 and the arms at the positions substantially parallel with the floor or other surface on which the sofa chair sits. The main body portion 24 of the slipcover 20 preferably terminates proximate the arms of the chair 50, and the skirt 30 extends downwardly from beneath the seat cushion and cinching element towards the floor. Because the skirt 30 extends from beneath the cushion portion of the chair 50, rather than from above it, in the manner of many prior art slipcover constructions, the positioning and appearance of the skirt remains relatively unaffected throughout the compression of the cushion, such that which would be caused by a person sitting on the chair.

It is important to observe with respect to the slipcover 20 of prior art FIG. 2 and the manner in which it is shown mounted in FIG. 3, that there is a co-extensive section 34 of the elastic bands 26 and 28 that become positioned on the front of the chair 50, as indicated. Because the two bands extend coextensively, section 34*a* of the first elastic band 26 does not become tucked under the seat cushion 39, whereby no separate and distinct definition of the front of the seat cushion 39 is provided. Thus, the cover provides only a semi-fitted appearance, clearly revealing to the observer that it is a slipcover, unable to project an actual furniture upholstery appearance on the furniture. The chair 50 also includes armrests 24 with tuck-in lines 25 and 37.

Figure 4:
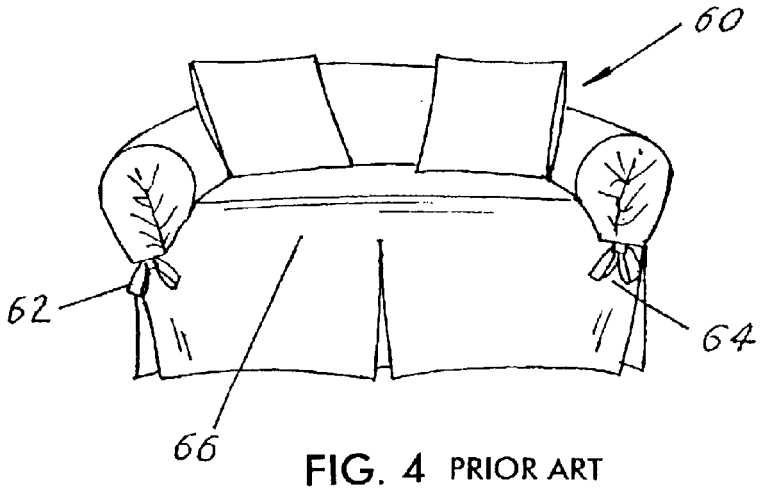
FIG. 4 PRIOR ART

Prior art FIG. 4 shows a modified form of the slipcover 20 of FIG. 3 which is mounted on a sofa 60, but which lacks the elastic band section 34 of FIG. 2. Therefore, material 66 at the front of the couch does not provide the gathered, pleated appearance and the section which does not have the elastic band at the section 34 is tightened by use of binding elements 62 and 64, each of which consist of first and second elements that are fastened together in a manner of a shoelace using a knot and a bow, to gather the material of the main body section around the body of the sofa.

Figure 5:
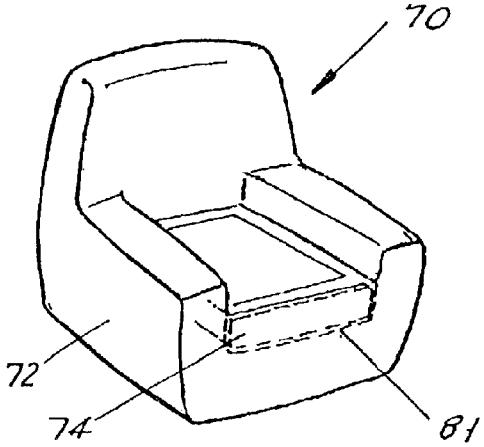
FIG. 5 PRIOR ART
FIGS. 5 and 6 respectively show, in a perspective and cross-sectional views, the prior art slipcover which is illustrated in British patent specification 1 300 582.
Figure 6:
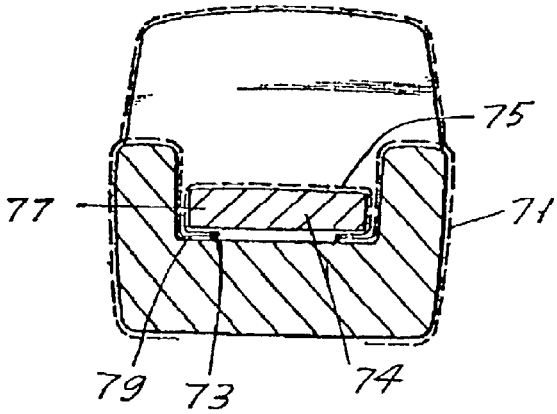
FIG. 6 PRIOR ART

Prior art FIG. 5 illustrates a sofa chair 70 having a body 72 and a cushion portion 74. This chair 70 is shown in cross-section in FIG. 6 to include a slipcover 71 that defines a pocket 75 for the seat cushion 74 with the perimeter or opening into the pocket 77 being defined by a portion 79 of the material which becomes tucked under the cushion through the action of an elastic band 73. Therefore, at the location 81 (FIG. 5), the material of the slipcover 71 is gathered underneath the seat cushion 74 on the front face of the sofa chair 70 as well. The prior art embodiment in FIGS. 5 and 6 differs from that of prior art FIG. 2 in that the latter embodiment does not disclose the second elastic member 28, which defines the further pocket for the main body portion of the slipcover.

Figure 7A:
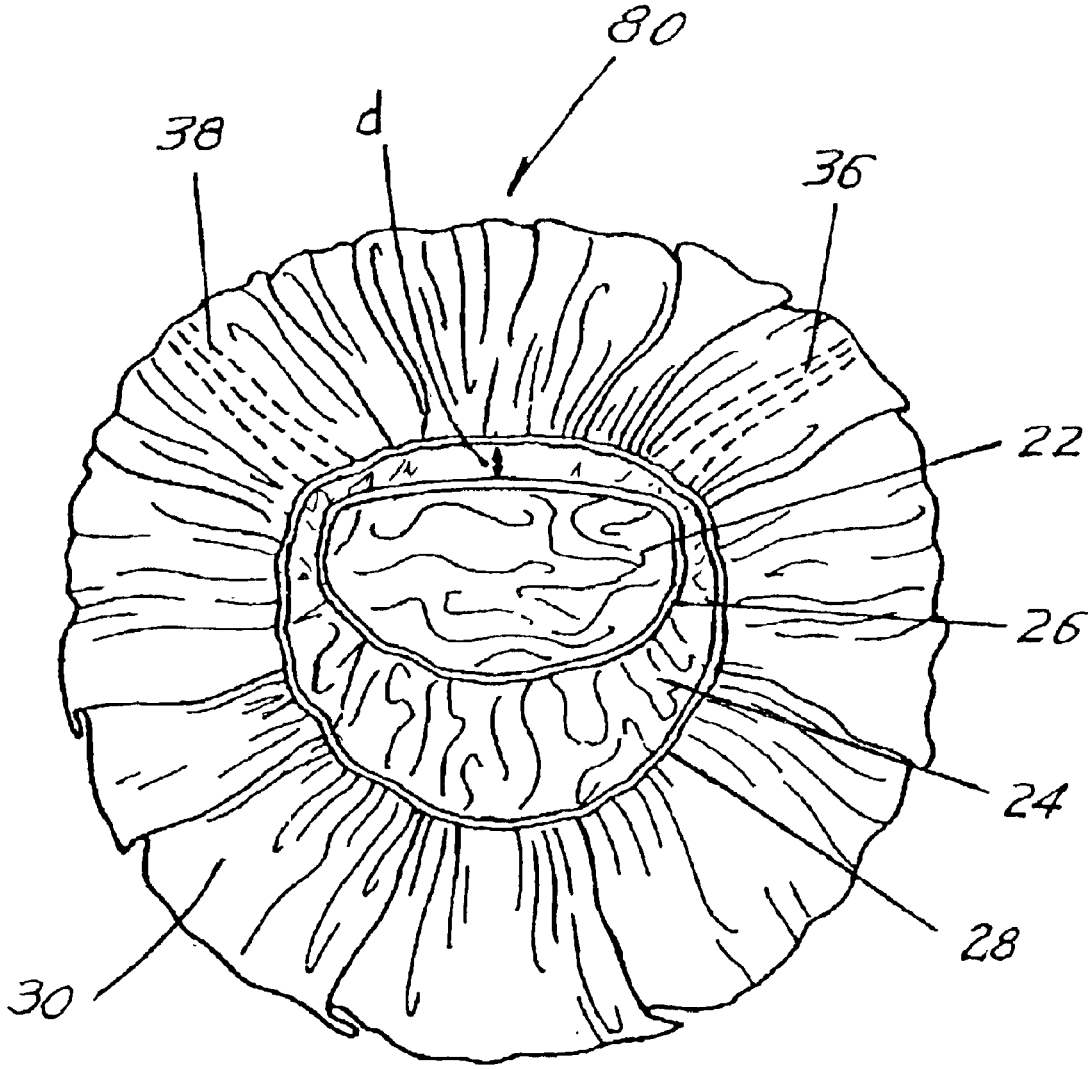
FIG. 7*a* shows in plan view a slipcover according to an embodiment of the present invention, as it appears in a flattened condition prior to being positioned on a piece of furniture.

Having thus described the prior art, reference is made to several embodiments of the invention, commencing with FIG. 7*a* which shows the novel slipcover 80 of the present invention which, in a manner similar to the embodiment of FIG. 2, comprises the seat cushion pocket 22, as well as the main body portion 24. Further, in a manner generally similar to the embodiment of FIG. 2, there is provided a first cinching element in the form of an elastic band 26 and a second cinching element in the form of an elastic band 28 with an important distinction. In FIG. 7*a*, there is no co-extensive section 34 of the two elastic bands, i.e., cinching elements 26 and 28. Instead, in the region of the front of the slipcover, these bands are separated from one another by a distance "d", which is specifically designed to be wide enough, for example, at least one-half inch, and preferably about two inches, to allow the entirety of the elastic band 26, which defines the mushroom-shaped seat cushion covering portion 22, to be tucked under the seat cushion 18 to provide a more fitted look and appearance to the slipcover 80 when it is positioned on a sofa or a chair or another piece of furniture. Not only does this expedient provide a more fitted appearance for the slipcover, but in addition, it aids in preventing wrinkling and bunching of the material as a person sits down or gets up from the furniture, since the resilient member cinching element 26 will always act to tightly hold and gather at least a portion of the material between the two cinching elements of the slipcover under the seat cushion. However, the distance "d" need not be constant, for example, it may be larger at the center and taper down in size toward its edges.

Figure 7B:
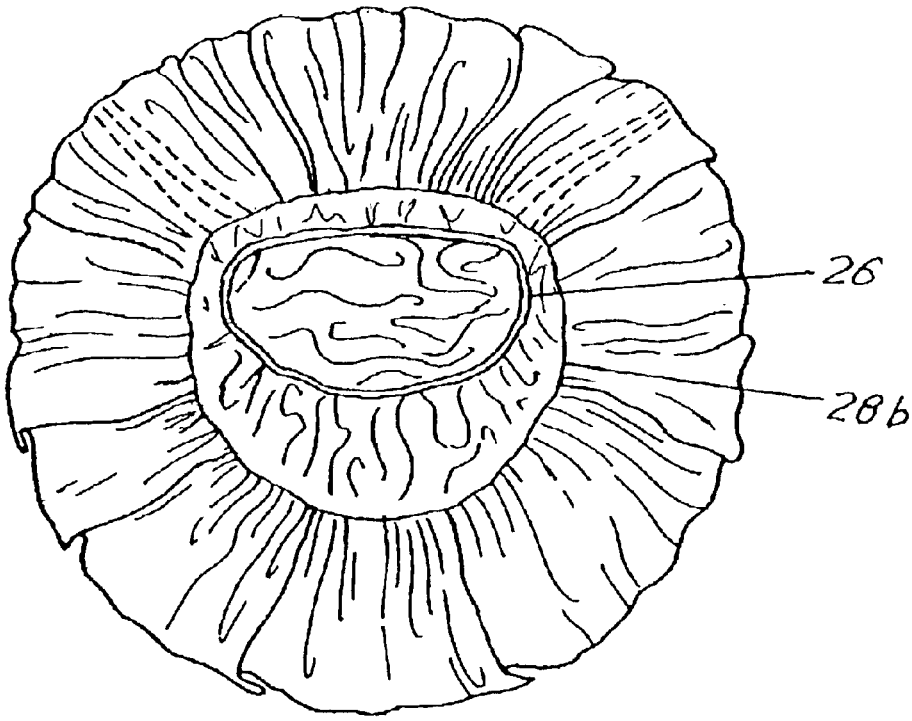
FIG. 7*b* shows in plan view a slipcover according to a further embodiment of the present invention, as it appears in a flattened condition prior to being positioned on a piece of furniture.
Figure 7C:
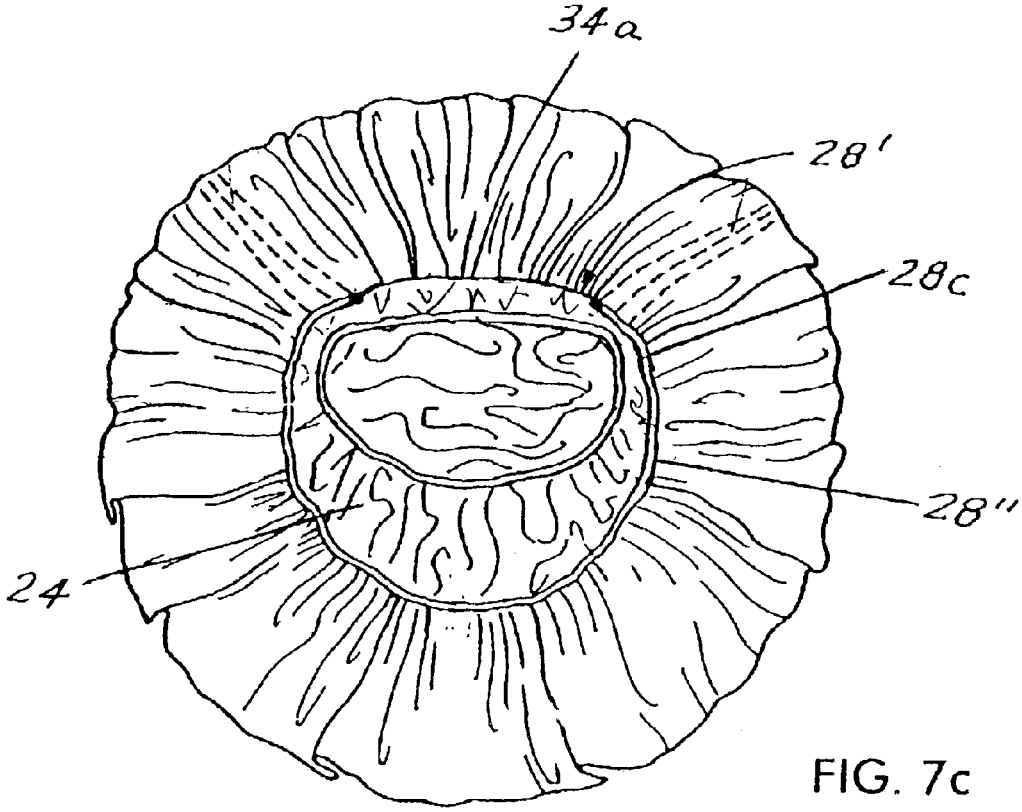
FIG. 7*c* shows in plan view a slipcover according to another variation of the present invention, as it appears in a flattened condition prior to being positioned on a piece of furniture.
Figure 7D:
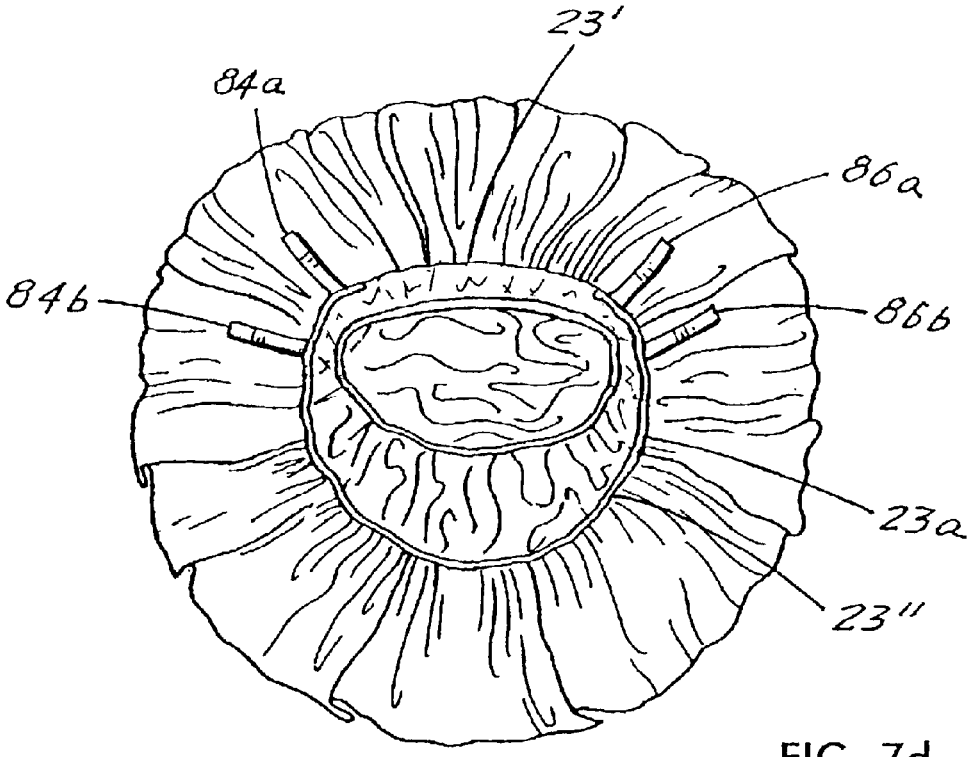
FIG. 7*d* shows in plan view a slipcover showing yet a further embodiment of the present invention, as it appears in a flattened condition prior to being positioned on a piece of furniture.

The concept of the present invention of providing both a separate main body portion pocket 24 and a seat cushion pocket 22 which are separately defined and which do not have any co-extensive portions, is further reproduced in modified embodiments in FIGS. 7*b*–7*g*. Thus, in FIG. 7*b*, the entirety of the cinching member 28*b* is made of non-elastic material, rather than the elastic material, of which the elastic band 26 is constructed. In the embodiment of FIG. 7*c*, the cinching element 28*c* for the main body portion 24 is made of two portions, including a non-elastic cinching element 28' which approximately spans the distance or the span indicated by 34 in FIG. 2 and a second portion 28" which is made of elastic material. In the embodiment of FIG. 7*d*, there are added left-hand and right-hand pairs of fastening ties or bands 84*a*, 84*b* and 86*a*, 86*b* which, upon mounting of the slipcover onto a piece of furniture, allow the slipcover to be tightened to hug the furniture to remove any pleating or shirring appearance from the portion 28' of the cinching element 28*c*.

Figure 7E:
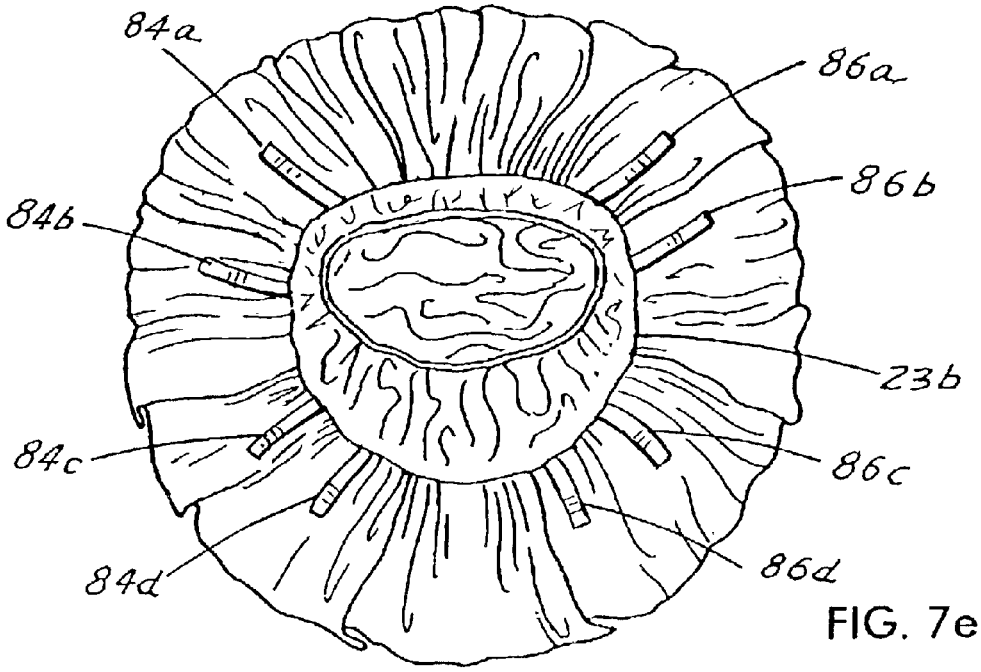
FIG. 7*e* shows in plan view a slipcover according to another aspect of the present invention, as it appears in a flattened condition prior to being positioned on a piece of furniture.

The embodiment of FIG. 7*e* adds the ties 84*a*, 84*b*, 86*a*, 86*b* to the embodiment of FIG. 7*b*. Two pairs of additional ties 84*c*, 84*d* and 86*c*, 86*d* can be added adjacent the location where the slipcover hugs the rear corners of the piece of furniture. These additional pairs of ties can be added to other embodiments described above as well.

Figure 7F:
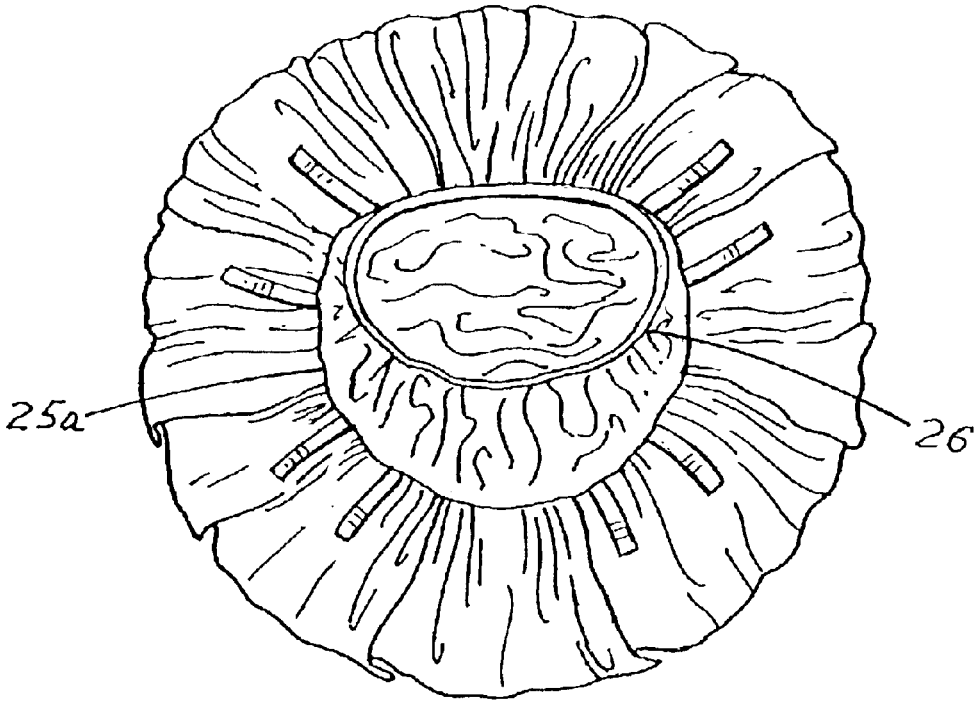
FIG. 7*f* shows in plan view, a slipcover according to another arrangement of its parts in accordance with the present invention, as it appears in a flattened condition prior to being positioned on piece of furniture.

Referring to FIG. 7*f*, here there is only a single cinching element 26. The line 25*a* represents the location of the sewing or stitching or attachment between the main body portion 24 and the ruffle 30. As in the other embodiments, fastening ties or bands can be included as shown.

Figure 7G:
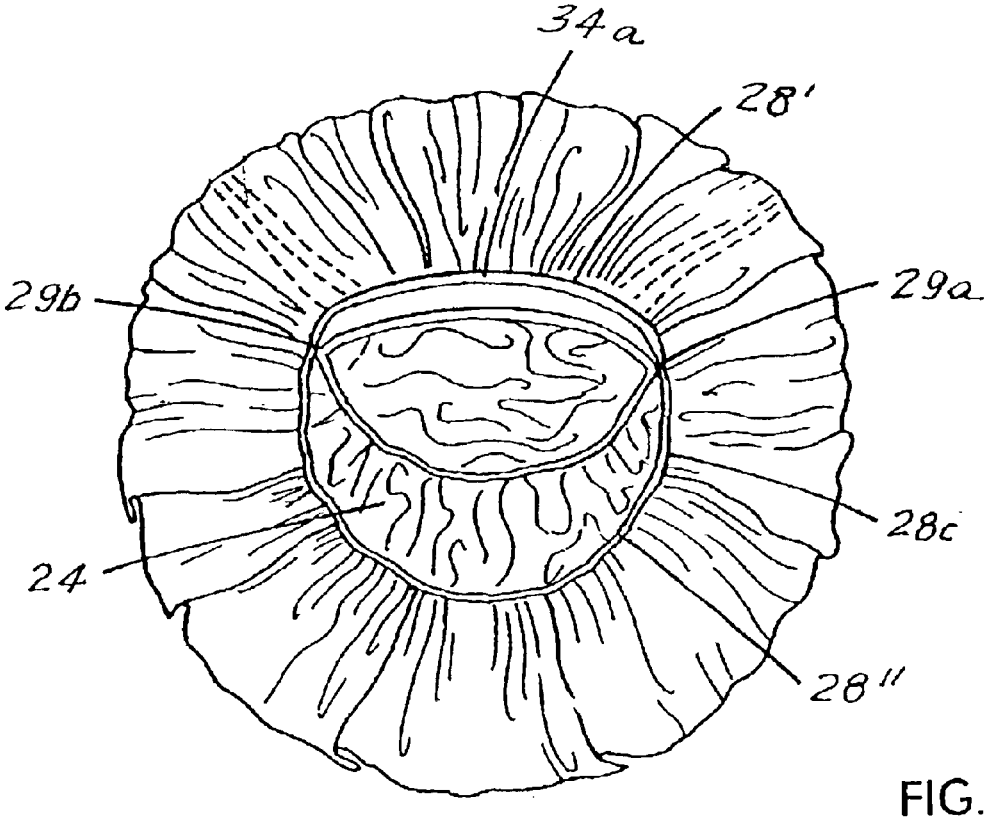
FIG. 7*g* shows in plan view, a slipcover according to FIG. 7*a*, with detail modifications.

In general, the embodiment of FIG. 7*g* is modeled on the slipcover of FIG. 7*a*, with the further proviso that contact points are provided between the first cinching element 26 and the second cinching element 28 at 29*a* and 29*b*. These points are preferably located adjacent the material of the slipcover which defines the aforementioned pockets for the armrests.

Figure 8:
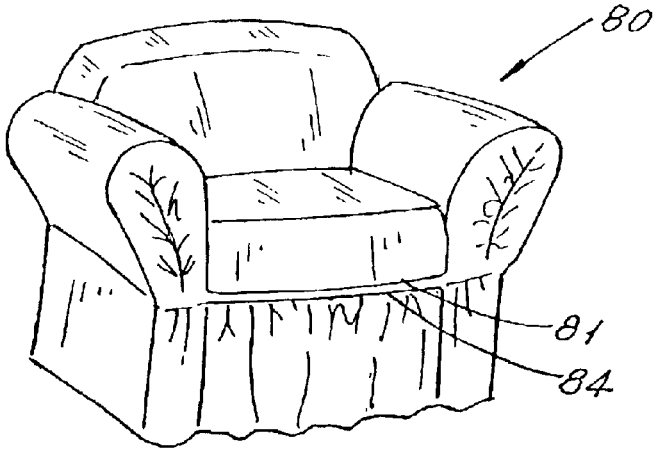
FIG. 8 is a perspective of a sofa chair with a slipcover constructed in accordance with the embodiment of FIG. 7*a*.

When the slipcover 80 of FIG. 7*a* is mounted on the sofa chair 90 shown in FIG. 8, the appearance of the slipcover 80 is changed in that a fold line 81 is defined which consists of the gathered material which is drawn underneath the seat cushion 18. Separately, there is a line 34 that runs along the front side and possibly around the sofa chair which represents the second elastic cinching element 28*c*. Note that the line 34 would not appear when using the slipcover embodiment of FIG. 7*f*.

Figure 9:
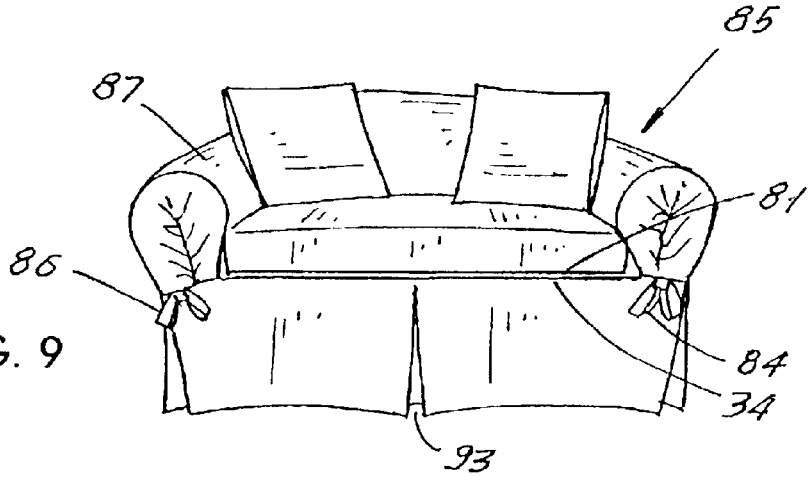
FIG. 9 is a perspective of a sofa with the slipcover constructed in accordance with the embodiment of FIG. 7*d* or 7*e*.

In FIG. 9, the similar slipcover 85 that, for example, is shown in FIG. 7*d* or 7*e*, is mounted and the same line 81 is again generated. In addition, the material at the front of the sofa 87 is not pleated because it is stretched out due to the action of the ties 84 and 86, as shown.

Figure 10:
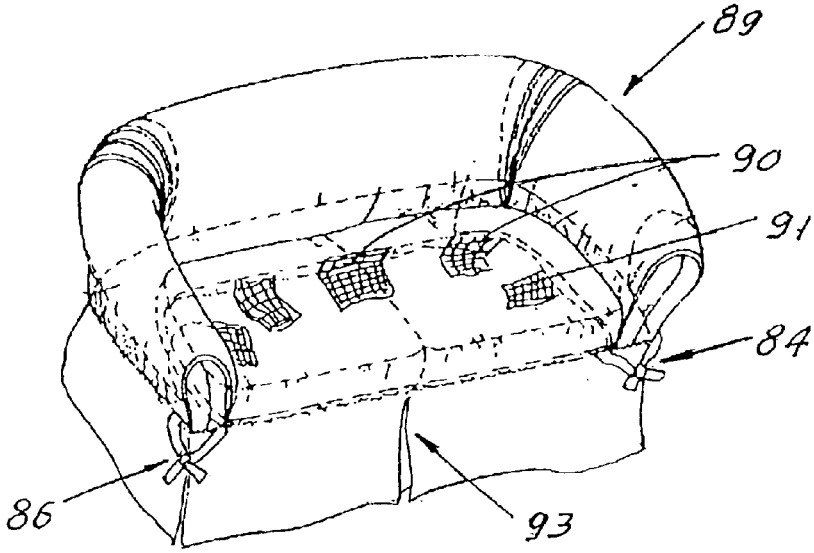
FIG. 10 is a perspective of a further embodiment of a slipcover in accordance with the present invention.

Referring to FIG. 10, a sofa 89 with the slipcover illustrated in FIG. 9 is shown here transparently to enable viewing the seat cushion cover portion including no-slip pads 90, 91 at the rear and at the sides of the cushions. When the slipcover is mounted, these pads 90, 91 are tucked under, to prevent slippage or stretching of the material off the seat cushions. This expedient can be provided in addition to the elastic band 26 or in lieu thereof. In such an embodiment, one may provide the elastic band 26 only along the front side of the couch and secure the material of the slipcover underneath the seat cushion along the sides and rear exclusively through the use of the no-slip pads 90, 91. This succeeds in preventing slippage from "back crease". These pads are typically constructed of rubber-woven cloth, commonly used underneath area rugs or carpets to prevent slippage. Excess fabric with the attached no-slip pads go into the creases and underneath the seating cushions, and the frictional effect of the no-slip pads works to achieve the desired effect.

Instead of using an "elasticized ruffle skirt", one may use a straight skirt with no elastic with a "kick pleat" 93 in front of the slipcover and a pair of ties on each of the four corners of the couch slipcover. Ties allow to adjust the slipcover to couches of different lengths. See FIG. 9.

The invention permits providing the slipcovers in as few as three sizes, for example, small, medium and large, so as to fit most couches that are typically available in the marketplace. But more sizes can be provided, for example, four or five or even more.

Figure 11A:
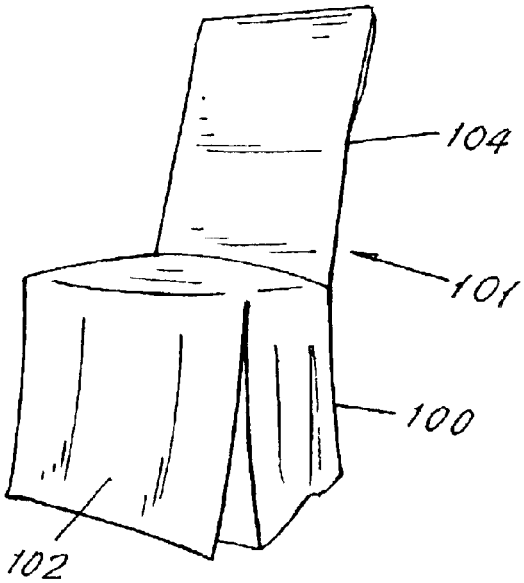
FIG. 11a PRIOR ART
FIGS. 11*a* and 11*b* are perspectives of a front and a back of an armless prior art chair with a slipcover.

FIG. 11*a* shows a prior art slipcover 100 especially designed for a hard-back rectangular chair 101, with the base 102 of the slipcover comprising a hanging rectangular skirt that fits over the base of the chair. A special pocket 104 of the slipcover 100 has a substantial height, but very narrow width, to slip over the backrest of the chair 101. Since the backrests of chairs come in too great a variety of height sizes, excess material 106 is folded back behind the chair 101 and the prior art teaches (FIG. 11*b*) to provide a pair of ties 108 at the seat level of the chair. These ties 108 can be fastened together across the back of the chair, as shown. The prior art expedient still results in a cluttered appearance.

Figure 11C:
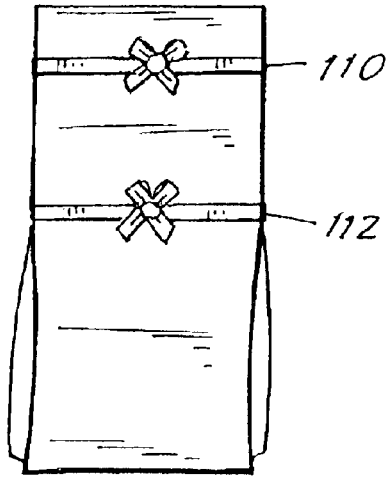
FIG. 11*c* shows a modified tie construction of the slipcover of FIGS. 11*a* and 11*c* constructed in accordance with a further embodiment of the invention.
Figure 11B:
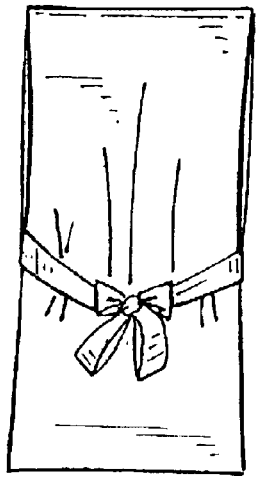
FIG. 11b PRIOR ART

To improve that look, the present invention provides, as shown in FIG. 11*c*, first and second ties, a first tie 110 being disposed towards the top and the other 112 towards the bottom, in a predetermined relationship, so that the excess material can be gathered up, as by rolling or other expedients or otherwise hidden and thereafter the two separate pairs of ties 110, 112 used to secure the excess material to provide a neat and pleasing appearance.

Figure 12A:
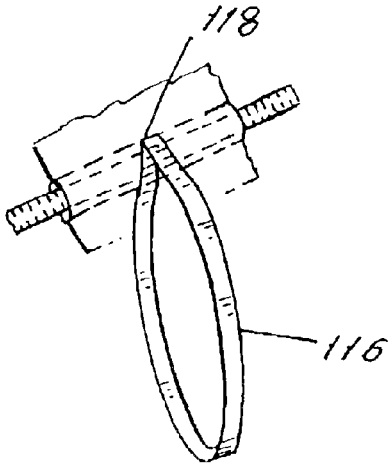
FIGS. 12*a* and 12*b* are perspectives of tie constructions, including for the embodiments of FIGS. 7*d*, 7*e*, 9, 10 and 11.
Figure 12B:
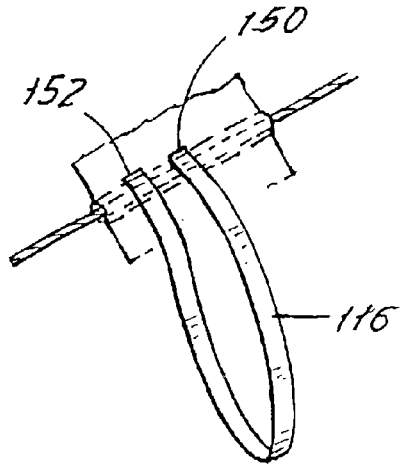

With reference to FIG. 12*a*, each tie (of each pair) used throughout the invention is preferably constituted not of a single band of material, but rather as a folded over band of material, creating a loop 116 that is sewn into the seam and secured only at one point 118 to the slipcover. This provides the advantage of not having to finish two separate ends of each tie. Alternatively, and as shown in FIG. 12*b*, each tie is secured at two adjacent points 150 and 152 to the fabric of the slipcover.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A slipcover for a piece of furniture including at least a base and at least one seat cushion, said slipcover comprising:

a pouch-shaped, seat cushion covering portion including a periphery and a circumference adjusting member extending endlessly adjacent the periphery for varying a peripheral dimension of the periphery;

a pouch-shaped, main body portion for covering the base of the piece of furniture, said main body portion having a perimeter adjusting member extending about a periphery of the main body for varying an effective peripheral dimension of the main body portion thereof; and wherein the perimeter adjusting member surrounds the circumference adjusting member, the perimeter adjusting member and the circumference adjusting member, running substantially alongside one another but with a sufficient spacing between them, such that when mounted on the piece of furniture, the circumference adjusting member is positioned tucked under the at least one seat cushion, while a section of the perimeter adjusting member remains exposed at the front of the piece of furniture to provide a slipcover that more closely appears as a part of the upholstery of the piece of furniture.

2. The slipcover of claim 1, in which both the circumference adjusting member and the perimeter adjusting member are each constructed as an endless, substantially elastic band.

3. The slipcover of claim 1, in which the circumference adjusting member is constructed substantially entirely of an elastic band material and wherein the perimeter adjusting member is constructed substantially along the entire extent thereof of a non-elastic, non-stretchable material.

4. The slipcover of claim 3, including first and second pairs of fastening ties disposed to enable the gathering of the material of the slipcover about the piece of furniture.

5. The slipcover of claim 4, wherein each of said pairs of fastening ties is constructed as an elongated band or material that is folded in half with free ends of the fastening ties thereof being sewn to the slipcover with each of said fastening ties defining a loop.

6. The slipcover of claim 1, wherein the circumference adjusting member is constructed substantially throughout thereof of an elastic band material and wherein the perimeter adjusting member is constructed of a first portion that is non-elastic and non-stretchable, which is co-extensive with the parallel section thereof, and a second portion which is constructed substantially entirely of an elastic band material.

7. The slipcover of claim 6, including first and second pairs of fastening ties disposed to enable the gathering of the material of the slipcover about the piece of furniture.

8. The slipcover of claim 7, wherein each of said pair of fastening ties is constructed as an elongated band or material that is folded in half with the free ends thereof being sewn to the slipcover with each fastening tie defining a loop.

9. The slipcover of claim 1, further including non-slip pads attached to the seat cushion covering portion adjacent the circumference adjusting member.

10. The slipcover of claim 1, wherein said circumference adjusting member comprises an elastic band secured to the periphery of the seat cushion covering portion.

11. The slipcover of claim 10, wherein said elastic band is secured while in a stretched configuration such that the peripheral dimension of the seat cushion covering portion is reduced when the elastic band assumes a relaxed state.

12. The slipcover of claim 1, wherein said perimeter adjusting member comprises an elastic band secured to the periphery of the main body portion.

13. The slipcover of claim 12, wherein said elastic band is secured while in a stretched configuration such that the peripheral dimension of the main body portion is reduced when the elastic band assumes a relaxed state.

14. The slipcover of claim 1, further comprising a skirt portion secured to the seat covering portion and the main body portion.

15. The slipcover of claim 1, wherein said main body portion terminates in the first and second ends, said ends refining semi-fitted arm portions for neatly conforming to arms of the piece of furniture.

16. The slipcover of claim 1, wherein the piece of furniture is a sofa.

17. The slipcover of claim 1, wherein the piece of furniture is an upholstered chair.

18. The slipcover of claim 1, in which the circumference adjusting member and the perimeter adjusting member extends substantially parallel to one another along portions thereof that extend alongside one another.

19. The slipcover of claim 1, in which the circumference adjusting member and the perimeter adjusting member approach and abut one another at first and second points which define ends of a section wherein the circumference adjusting member and the perimeter adjusting member that run substantially alongside one another.

* * * * *